US005454446A

United States Patent [19]

Zelikovitz

[11] Patent Number: 5,454,446

[45] Date of Patent: Oct. 3, 1995

[54] FREESTANDING EXTENSION LADDER

[76] Inventor: Joseph Zelikovitz, P.O. Box 52, Teton Village, Wyo. 83025

[21] Appl. No.: 217,495

[22] Filed: Mar. 24, 1994

[51] Int. Cl.[6] ..... E06C 1/22

[52] U.S. Cl. ..... 182/172; 182/107

[58] Field of Search ..... 182/180, 172, 182/118, 107–111, 173

[56] References Cited

U.S. PATENT DOCUMENTS

| | | | |
|---|---|---|---|
| 105,126 | 7/1870 | Pullman | 182/172 X |
| 1,359,297 | 11/1920 | Voss . | |
| 1,670,653 | 5/1928 | Cummins . | |
| 3,059,723 | 10/1962 | Shore | 182/107 |
| 3,288,248 | 11/1966 | Gurian et al. | 182/118 |
| 4,004,652 | 1/1977 | Laboy | 182/118 |
| 4,172,641 | 11/1979 | Reyes | 182/172 |
| 4,630,819 | 12/1986 | Levin | 182/118 X |

FOREIGN PATENT DOCUMENTS

| | | | |
|---|---|---|---|
| 1409225 | of 0000 | France . | |
| 544218 | of 0000 | Germany . | |
| 560265 | of 0000 | Germany . | |
| 312628 | 3/1956 | Switzerland | 182/172 |
| 1201-477-A | of 0000 | U.S.S.R. . | |
| 2182086 | 5/1987 | United Kingdom . | |

*Primary Examiner*—Alvin C. Chin-Shue
*Attorney, Agent, or Firm*—Jones & Askew

[57] ABSTRACT

A freestanding extension ladder is disclosed which has lower and upper ladder sections joined together in slidable relation such that the upper ladder section is extensible above the lower ladder section and retractable to be generally coextensive with the lower ladder section. A longitudinal bracing frame having a length generally corresponding to the length of the lower ladder section has its upper end attached to the upper end of the lower ladder section and extends downward and longitudinally outward therefrom. Transverse base members are mounted to the lower end of the lower ladder section and the longitudinal bracing frame and extend laterally therefrom. A pair of spars have upper ends attached one to either side of the lower ladder section at its upper end and extend downward and laterally outward therefrom. The resulting ladder is free standing yet extensible to permit access to locations which are higher than conventional step ladders but which lack a suitable surface against which the upper end of a conventional extension ladder can be braced.

13 Claims, 5 Drawing Sheets

*Fig. 1*

FREESTANDING EXTENSION LADDER

TECHNICAL FIELD

The present invention relates generally to ladders, and relates more specifically to a freestanding extension ladder with lateral stabilizing means.

BACKGROUND OF THE INVENTION

Most general purpose ladders fall into one of two categories. The first type of ladder, the extension ladder, comprises upper and lower ladder sections, each comprised of a pair of generally parallel, spaced-apart rails having a plurality of rungs extending therebetween. The upper and lower extension ladder sections are slidebly mounted such that the upper ladder section is slidebly extensible with respect to the lower ladder section. In this manner, the upper ladder section can be extended, either fully or partially, to provide additional height when in use, and then slidebly retracted until the two ladder sections are coextensive for storage.

The second type of ladder is the so-called "stepladder." The stepladder comprises a ladder section with generally parallel rails having a plurality of rungs extending therebetween. A bracing frame has an upper end attached to the upper end of the ladder section and extends downwardly and outwardly therefrom. A pair of standoff arms are connected to intermediate points of the ladder section and the bracing frame to hold the ladder section and the bracing frame in predetermined angular relation. When erected, the stepladder is configured generally like an "A."

Both the extension ladder and the stepladder have their own advantages and disadvantages. The extension ladder can be extended to heights of fifteen to twenty feet or more for use but then retract to a relatively manageable eight to ten feet in length for transport and storage. However, the extension ladder suffers the disadvantage that it depends for support upon its upper end resting against a suitable support structure, e.g., a wall or roof. The stepladder, on the other hand, is freestanding such that it can be used in locations where there is no suitable support structure against which the upper end of an extension ladder could rest. However, the stepladder suffers the disadvantage that it is typically limited to heights of six to ten feet. Further, since the user typically cannot stand atop the stepladder, or even on the highest rung of the stepladder, the height accessible by a stepladder is even further reduced. Providing stepladders in taller heights is generally impractical, because longer stepladders would be unacceptably awkward to transport and store. In addition, taller stepladders are more susceptible to toppling in a lateral direction and hence must have a wider base. However, the wider base would again be disadvantageous in terms of transporting and storing the ladder.

There are many applications for which neither a stepladder nor an extension ladder are suitable. It is often desirable, for example, to gain access to the ceiling of a two story foyer, or to a cathedral or vaulted ceiling, at locations remote from the vertical walls, such as for changing light bulbs or installing or repairing light fixtures or ceiling fans. In such applications an extension ladder is unsuitable because there is usually no nearby wall structure against which the upper end of the extension ladder can be leaned. On the other hand, a stepladder, which is not dependent upon the presence of a suitable wall structure for support, is not tall enough to provide access to such tall ceilings.

Thus there is a need for a ladder which combines the height of an extension ladder with the freestanding design of a stepladder.

SUMMARY OF THE INVENTION

Stated generally, the present invention comprises a ladder which extends to provide increased height and retracts for ease of transport and storage. However, the ladder in the present invention is freestanding and is not dependent upon the presence of a suitable support structure to support the upper end of the ladder. Further the ladder provides enhanced lateral stability against topping sideways without increasing the width of the ladder when stored.

Stated somewhat more specifically, the present invention comprises a freestanding extension ladder having lower and upper ladder sections each of which comprises a pair of generally parallel, spaced-apart rails and a plurality of rungs extending between the rails. The lower and upper ladder sections are joined together in slidable relation such that the upper ladder section is extensible above the lower ladder section and retractable to be generally coextensive with the lower ladder section. A longitudinal bracing frame having a length generally corresponding to the length of the lower ladder section has its upper end attached to the upper end of the lower ladder section and extends downward and longitudinally outward therefrom. A lateral stabilizing means is mounted to the lower end of the extension ladder for stabilizing the ladder against toppling in a lateral direction. In one aspect of the invention the lateral stabilizing means comprises transverse base members mounted to the lower end of the lower ladder section and the longitudinal bracing frame. In another aspect of the invention the lateral stabilizing means comprises a pair of spars having upper ends attached one to either side of the lower ladder section at its upper end and extending downward and laterally outward therefrom. In the disclosed embodiment the spars comprise telescoping spars having foot members mounted to their lower ends which are pivotable to conform to uneven support surfaces.

Thus it is an object of the present invention to provide an improved ladder.

It is a further object of the present invention to provide a ladder which affords greater height than a stepladder but which is not dependent upon leaning the upper end of the ladder against a support structure to support the ladder.

Another object of the present invention is to provide a freestanding ladder which is taller than a conventional stepladder but which compacts to a shorter length for ease of transport and storage.

It is still another object of the present invention to provide a freestanding ladder which has improved lateral stability.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
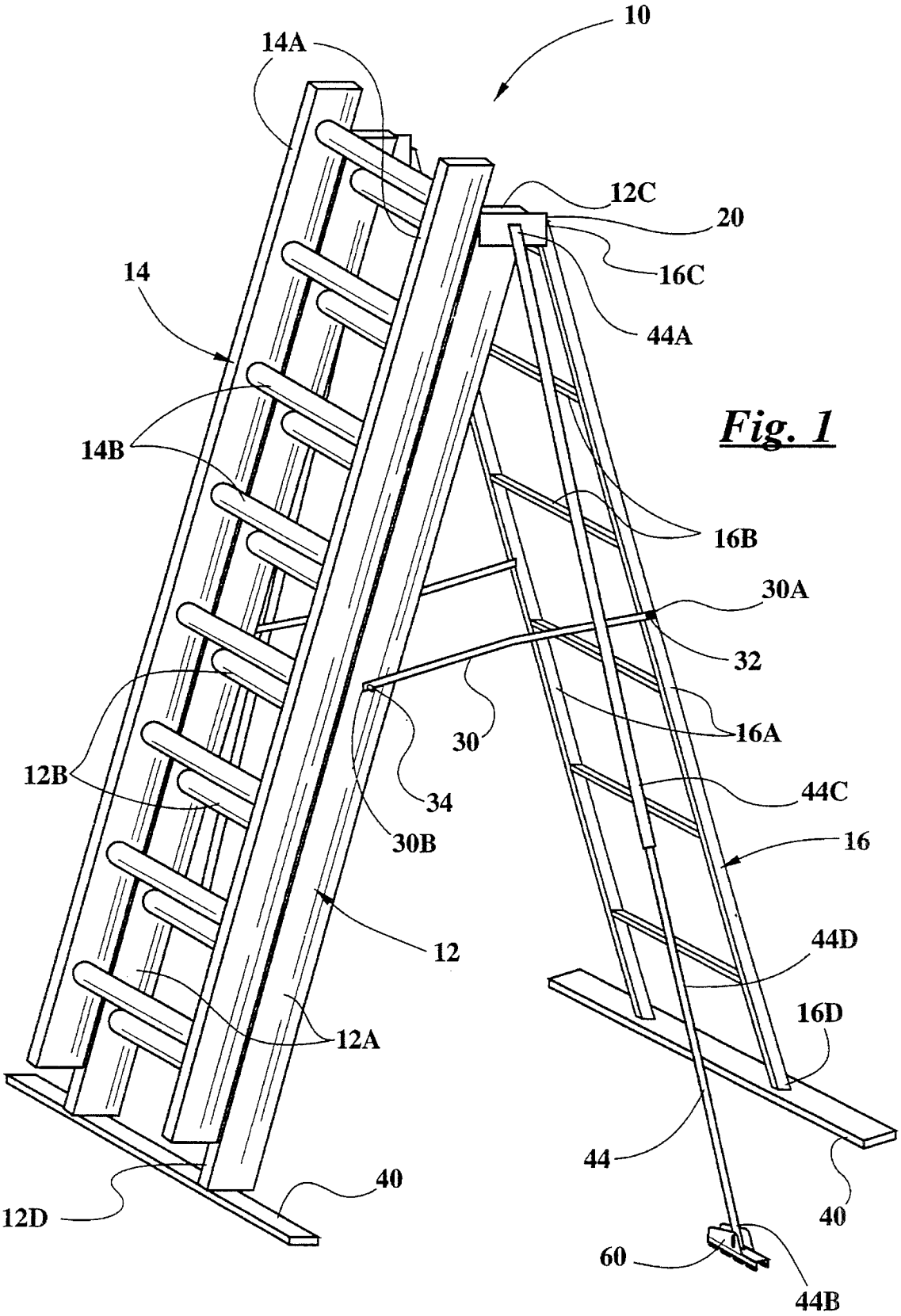
FIG. 1 is a perspective view of a freestanding extension ladder according to the present invention, showing the ladder in a retracted configuration.
Figure 2:
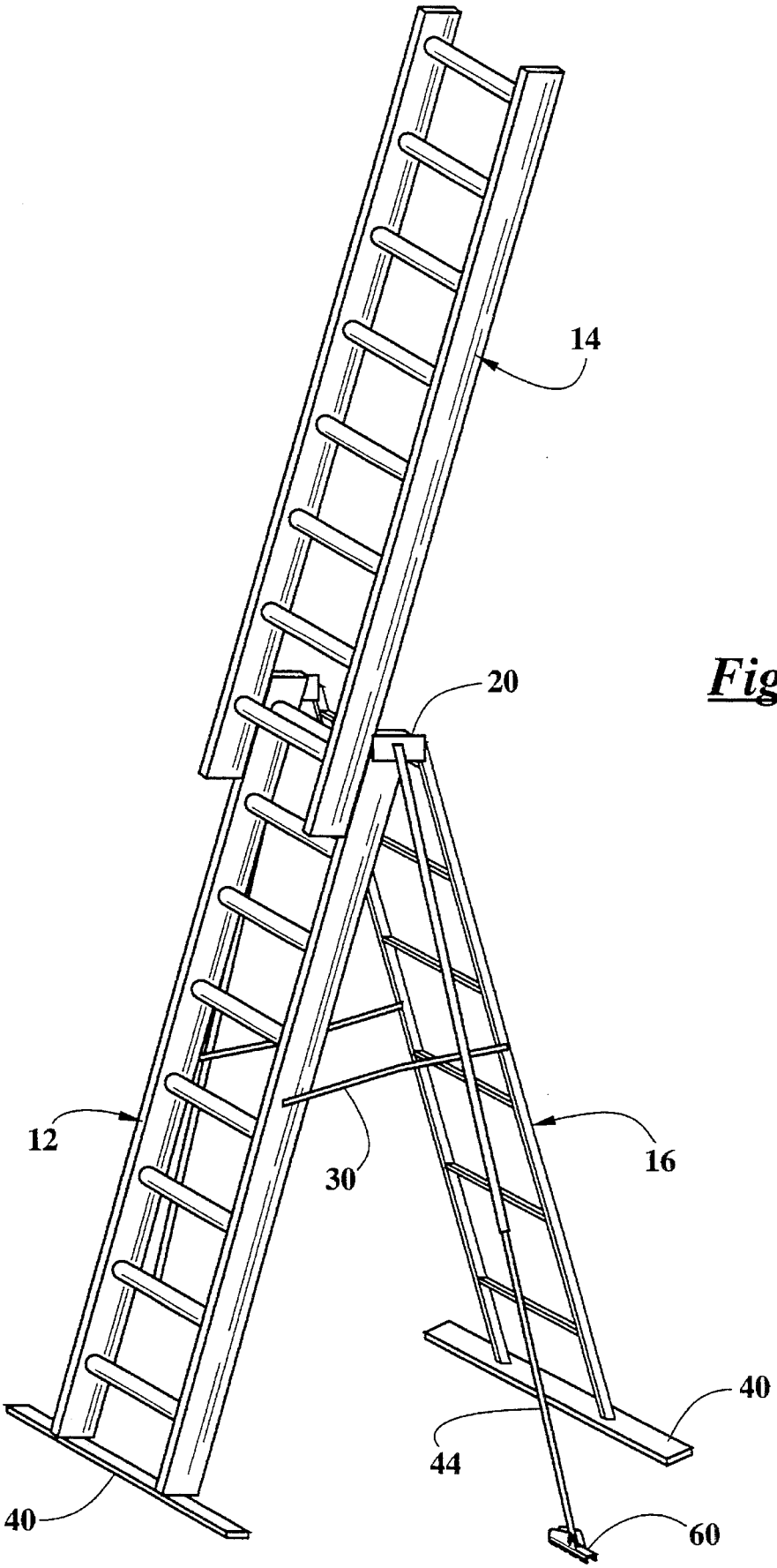
FIG. 2 is a perspective view of the ladder of FIG. 1 showing the ladder in an extended configuration.
Figure 3:
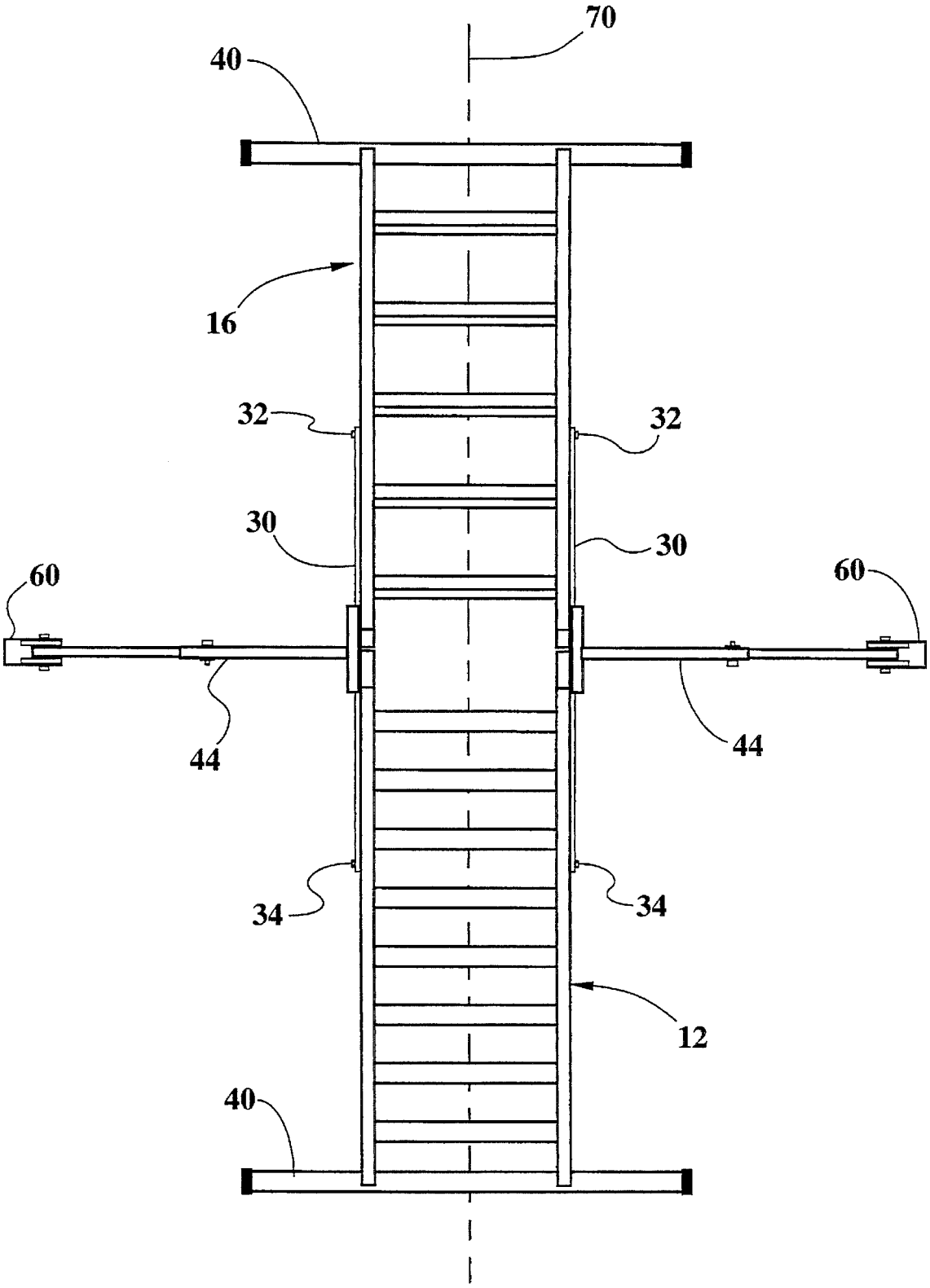
FIG. 3 is a top plan view of the ladder of FIG. 1 with the upper extension ladder section removed to show detail.

Referring now to the drawings, in which like numerals indicate like elements throughout the several views, FIGS. 1–3 illustrate a freestanding extension ladder 10 according to the present invention. The freestanding extension ladder 10 comprises a lower extension ladder section 12 and an upper extension ladder section 14. The lower extension ladder section 12 comprises a pair of generally parallel rails 12A having a plurality of rungs 12B extending therebetween. The lower extension ladder section 12 has an upper end 12C and a lower end 12D. Similarly, the upper extension ladder section 14 comprises a pair of rails 14A with a plurality of rungs 14B extending therebetween. The upper ladder section 14 is slidebly mounted to the lower ladder section 12 such that it can be extended above the lower ladder section for use, as depicted in FIG. 2, and then retracted to a position coextensive with the lower ladder section 12, as shown in FIG. 1, for transport and storage. The exact mechanism by which the upper 14 and lower 12 ladder sections are slidebly mounted is of conventional design well known to those skilled in the art and hence will not be described in detail herein.

It will be appreciated that some ladders, most notably conventional stepladders, comprise rails which are not strictly parallel but which diverge at their lower ends to provide a base which is broader than the upper end of the ladder. For purposes of this disclosure, rails which lie in true parallel alignment as well as rails which diverge somewhat at their lower ends will be deemed "generally parallel."

The freestanding extension ladder 10 further comprises an aluminum frame 16 comprising a pair of generally parallel, elongated rails 16A and a plurality of cross members 16B. The frame 16 has an upper end 16C which is pivotably attached to the upper end 12C of the lower extension ladder section 12. The frame 16 also has a lower end 16D. The frame 16 has a length and width generally corresponding to the length and width of the lower extension ladder section 12. In the disclosed embodiment, each extension ladder section 12, 14 is twelve feet long and sixteen inches wide, and consequently the rectangular frame 16 is also twelve feet long and sixteen inches wide.

Figure 4:
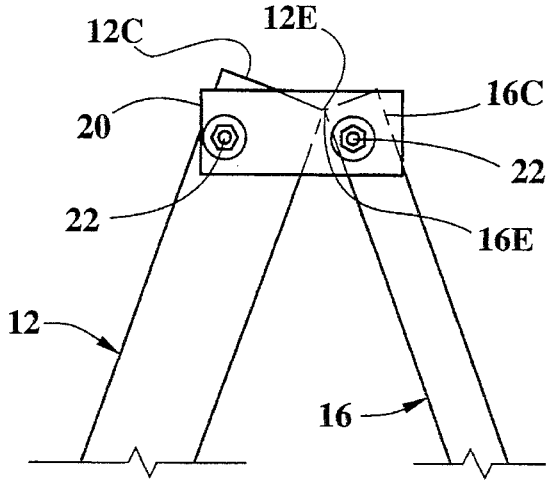
FIG. 4 is a front view of the attachment means of the ladder of FIG. 1 by which a lower extension ladder section is pivotably mounted to a rectangular support frame.

The mechanism by which the upper end 16C of the rectangular frame 16 is pivotably attached to the upper end 12C of the lower extension ladder section 12 is perhaps best illustrated in FIG. 4. A pair of attachment plates 20, which in the disclosed embodiment measure approximately three inches by five inches, are located one on either side of the ladder 10 adjacent the upper ends 12C, 16C of the lower extension ladder section 12 and rectangular frame 16. Bolts 22 are inserted through holes in the attachment plates 20 and through corresponding holes in the lower extension ladder section 12 and rectangular frame 16. In this manner both the lower ladder section 12 and the rectangular frame 16 are pivotably mounted to the attachment plates 20. The rectangular frame 16 can thus be folded against the lower extension ladder 12 for storage, in the manner of a conventional stepladder. When it is desired to use the freestanding extension ladder 10, the lower end 16D of the rectangular frame 16 is pivoted away from the lower end 12D of the lower ladder section 12. In the disclosed embodiment, the spacing between the holes and the attachment plates 20 is such that when the rectangular frame 16 has been unfolded from the lower ladder section 12 by the desired amount, the inner comer 12E at the upper end 12C of the lower extension ladder section 12 confronts the interior comer 16E at the upper end 16C of the rectangular frame 16 to control the extent to which the rectangular frame 16 can be unfolded.

While the attachment plates 20 of the disclosed embodiment are pivotably attached to both the lower extension ladder section 12 and the rectangular frame 16, it will be appreciated that similar results can be achieved by fixedly mounting the attachment plates 20 to either the lower extension ladder section 12 or rectangular frame 16 and then pivotably mounting the attachment plates to the other of the lower extension ladder section or rectangular frame.

Referring again to FIGS. 1–3, the freestanding extension ladder 10 further comprises a pair of spreader arms 30 extending between the midpoint of the lower extension ladder 12 and the midpoint of the rectangular frame 16. In the disclosed embodiment, a first end 30A of each of the spreader arms 30 is pivotably mounted to the rectangular frame 16 by means of a bolt 32. The second end 30B of each spreader arm 30 is notched to latch onto a peg 34 projecting from the rails 12A of the lower ladder section 12.

Transverse base members 40 are mounted to the lower end 12D of the lower extension ladder section 12 and to the lower end 16D of the rectangular frame 16. The transverse base members 40 have a length which is substantially greater than the width of the lower extension ladder section 12 and rectangular frame 16, such that the transverse base members extend well outward of the lower extension ladder section and the rectangular frame in a lateral direction. In the disclosed embodiment the transverse base members 40 are pivotably mounted to the lower ends 12D, 16D of the lower ladder section 12 and rectangular frame 16 about a transverse axis of rotation. In this manner the transverse base members 40 can pivot with respect to the lower extension ladder section 12 to conform to uneven support surfaces.

Figure 5A:
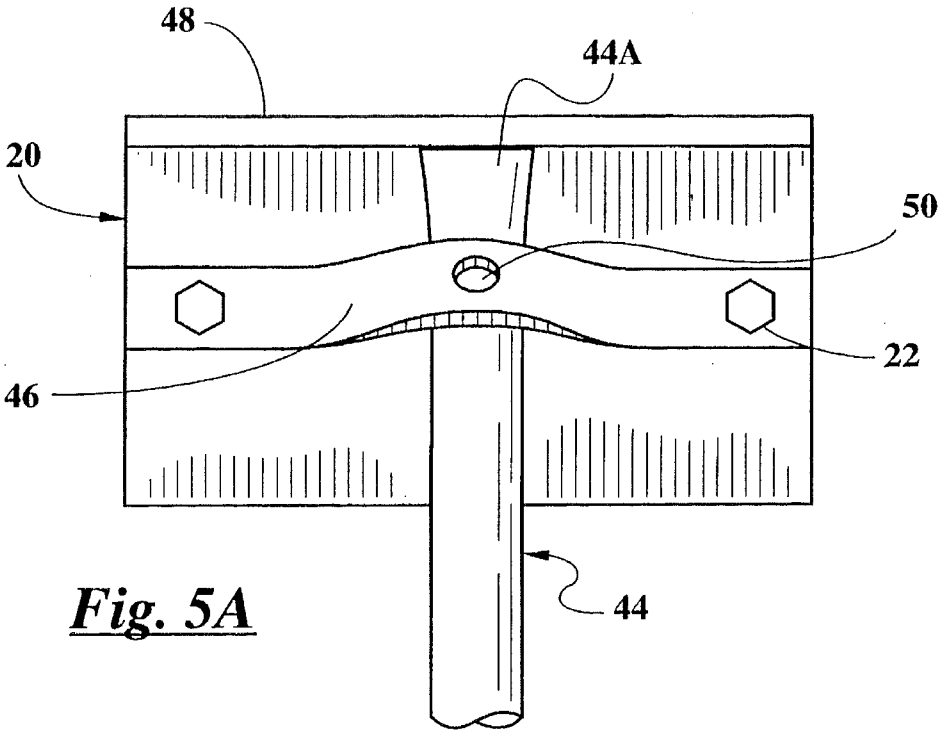
FIG. 5A is a front view of the attachment means of FIG. 4 depicting a keeper for attaching a stabilizing spar to the ladder.
Figure 5C:
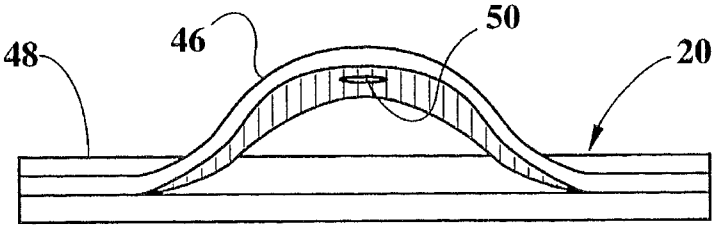
FIG. 5C is a bottom view of the attachment means with keeper.
Figure 5B:
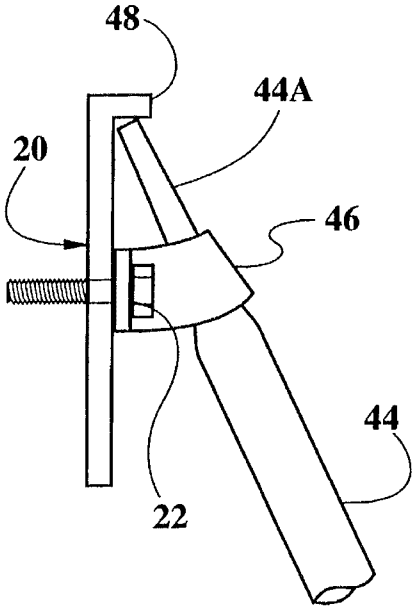
FIG. 5B is a side view of the attachment means with keeper.

Still referring to FIGS. 1–3, the freestanding extension ladder 10 further comprises a pair of lateral stabilizing spars 44. As shown in FIGS. 5A–C, the lateral stabilizing spars 44 have upper ends 44A affixed to the attachment plates 20. The upper ends 44A of the stabilizing spars 44 are somewhat flattened and are received within a keeper 46 mounted on each of the attachment plates 20. Each keeper 46 is attached to its respective attachment plate 20 by means of the same pair of bolts 22 which attach the lower ladder section 12 and rectangular frame 16 to the attachment plate. A horizontal flange 48 is formed at the top of each attachment plate 20, and the upper end 44A of the stabilizing spar 44 abuts this flange. In addition a locking pin is inserted through a hole 50 in the keeper 46 and through a corresponding hole in the upper end 44A of the stabilizing spar to further secure the spars 44 to their respective attachment plates 20.

Figure 6:
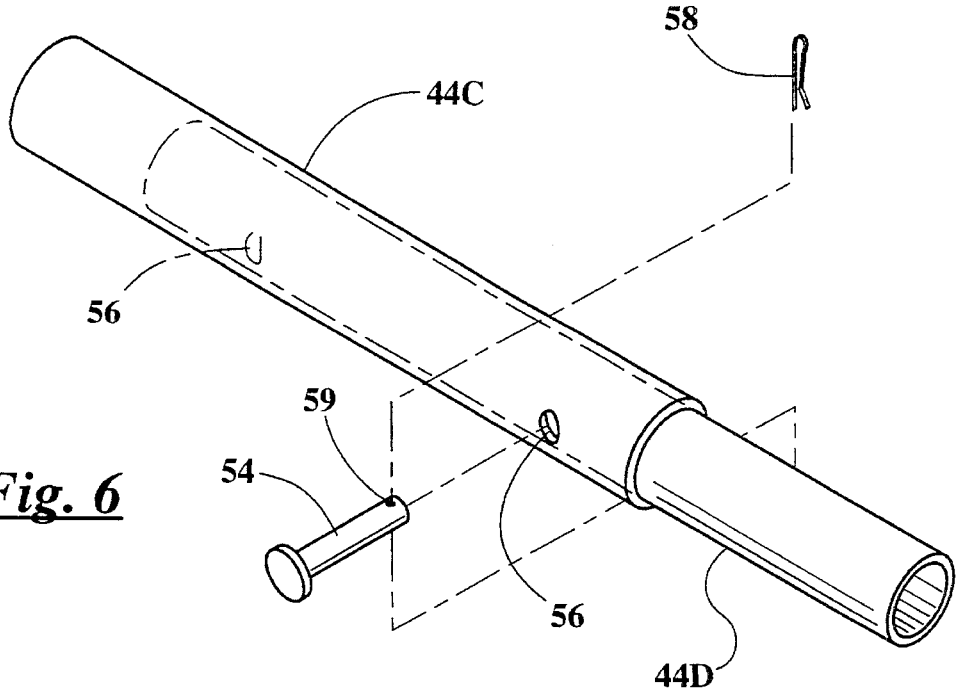
FIG. 6 is a perspective view of a section of the stabilizing spar of FIGS. 5A–C illustrating a telescoping arrangement between upper and lower spar sections.

The lateral stabilizing spars 44 extend downward and laterally outward and have lower ends 44B. In its disclosed embodiment the spars 44 are comprised of upper and lower telescoping elements 44C, 44D. As shown in FIG. 6, a locking pin 54 is inserted through corresponding holes 56 in the upper and lower telescoping elements 44C, 44D to fix the extended telescoping elements during use. The lower telescoping element 44D, which is the inner of the two telescoping elements, comprises a plurality of holes 56 at regularly spaced intervals to permit the spars 44 to be fixed at various predetermined lengths. After the locking pin 54 has been inserted through the holes 56, a cotter pin 58 is inserted through a hole 59 in the end of the locking pin 54 to prevent the locking pin from being accidentally dislodged from the holes 56 in the telescoping spar sections 44C, 44D.

Figure 7:
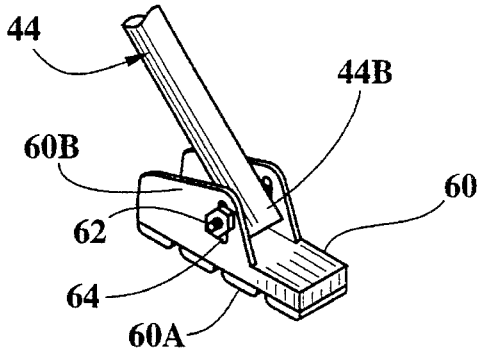
FIG. 7 is a perspective view of a foot member of the ladder of FIG. 1, which foot member is mounted to the lower end of the stabilizing spar.

As can be seen in FIG. 7, a foot member 60 is pivotably mounted to the lower end 44B of each spar 44 to rests on the support surface, e.g., the ground or the floor. The foot members 60 have non-skid lower surfaces 60A. The foot members further comprise a bracket portion 60B defining a channel within which the lower end 44B of the spar 44 is received. A bolt 62 extends through slots 64 in the bracket portion 60B and through corresponding holes in the lower end 44B of the spar 44 to attach the foot member pivotably to the spar. The pivotable attachment between the foot members 60 and the lower ends 44B of the spars 44 permits the foot members to conform to uneven support surfaces.

Referring now to FIG. 3, the ladder 10 has a longitudinal axis indicated by the line 70. As can be seen, the rectangular frame 16 supports the ladder 10 in a longitudinal direction, while the transverse base members 40 and spars 44 provide lateral support to the ladder to prevent it from toppling sideways.

While the ladder 10 of the present invention can be constructed from the outset as a freestanding extension ladder, it is expected that the frame 16, the transverse base members 40, and the spars 44 will most often be provided as an addendum to a conventional extension ladder. In such an instance, the ladder 10 will be assembled as follows.

The rectangular frame 16 will be provided with attachment plates 20 already pivotably attached to its upper end 16C, with the spreader arms 30 pivotably attached to its midpoint, and with a transverse base member 40 pivotably mounted to its lower end 16D. To attach this assembly to a conventional extension ladder, the attachment plates 20 are bolted to the upper end 12C of the lower extension ladder section 12. At this stage of assembly, the rectangular frame 16 can be folded against the extension ladder sections 12, 14 to transport or store the ladder 10. In addition, a transverse base member 40 is assembled onto the lower end 12D of the lower extension ladder section 12. For those extension ladders which already have individual pivotable foot members mounted to the lower end of each rail 12A, those foot members are removed and replaced with the transverse base member 40.

To use the ladder 10, the transverse base members 40 at the lower ends 12D, 16D of the lower extension ladder section 12 and rectangular frame 16 are placed on the support surface, and the lower end 12D of the frame 12 is unfolded. When the frame 16 has been spread to the desired angle, the confrontation between the mutually facing upper edges 12E, 16E of the lower ladder section 12 and frame 16 will prevent the ladder 10 from unfolding further. The spreader arms 30 are then attached to the lower extension ladder section 12 by inserting the notched ends 30B over the pegs 34 on the lower extension ladder section 12. The upper ends 44A of the spars 44 are then inserted into their respective sockets 52 to secure the spars to the attachment plates 20. The spars 44 are telescoped to the desired length, and the pin 54 is inserted through the appropriate holes 56 in the upper and lower telescoping sections 44C, 44D to fix the telescoping relation. When thus assembled, the foot members 60 rest on the support surface.

The upper extension ladder section 14 can then be extended above the upper end 12C of the lower extension ladder section 12 to the desired height. As may be dictated by the circumstances of the particular application, the upper extension ladder section 14 can be extended either fully, as shown in FIG. 2, or partially. The frame 16 stabilizes the ladder 10 in a longitudinal direction, and the two lateral stabilizing means, i.e., the transverse base members 40 and the lateral stabilizing spars 44, provide lateral stability to prevent the ladder from toppling sideways. When thus erected, the freestanding extension ladder 10 can be extended to a height well above that of a conventional stepladder without having to rest the upper end of the upper extension ladder section 14 against a support surface and without danger of the ladder toppling sideways.

Finally, it will be understood that the preferred embodiment has been disclosed by way of example, and that other modifications may occur to those skilled in the art without departing from the scope and spirit of the appended claims.

What is claimed is:

1. A freestanding extension ladder comprising:

a lower ladder section comprising a pair of generally parallel, spaced-apart rails and a plurality of rungs extending between said rails;

an upper ladder section comprising a pair of generally parallel, spaced-apart rails and a plurality of rungs extending between said rails;

said lower and upper ladder sections being joined together in slidable relation such that said upper ladder section is extensible above said lower ladder section and retractable to be generally coextensive with said lower ladder section;

a longitudinal bracing frame having an upper end attached to an upper end of said lower ladder section and extending downward and longitudinally outward therefrom, said frame having a length generally corresponding to the length of said lower ladder section;

a pair of attachment plates, one of said plates mounted to an upper portion of each of said lower ladder sections, said attachment plates each having a horizontal lip extending outward from an upper portion thereof;

a keeper mounted to each of said plates, each of said keepers having a portion spaced apart from a corresponding one of said plates so as to define an opening between said keeper and said plate; and a pair of spars having upper ends attached one to either side of said lower ladder section, said upper ends of said spars being received within said openings defined between said keepers and said plates, said upper ends of said spars abutting said horizontal lip, said spars extending downward and laterally outward and having a lower end which rests upon a support surface so as to provide lateral stability to said ladder.

2. The extension ladder of claim 1, further comprising a transverse base member attached to the lower end of said lower ladder section and extending laterally outward therefrom.

3. The extension ladder of claim 1, further comprising a transverse base member attached to the lower end of said longitudinal bracing frame and extending laterally outward therefrom.

4. The extension ladder of claim 2, wherein said transverse base member comprises a first transverse base member, and wherein said extension ladder further comprises a second transverse base member attached to the lower end of said longitudinal bracing frame and extending laterally outward therefrom.

5. The extension ladder of claim 2, wherein said transverse base member is pivotably attached to said lower end of said lower ladder section, whereby said transverse base member can pivot to conform to an uneven support surface.

6. The extension ladder of claim 3, wherein said transverse base member is pivotably attached to said lower end of said longitudinal bracing means whereby said transverse base member can pivot to conform to an uneven support surface.

7. The extension ladder of claim 4, wherein at least one of said transverse base members is pivotably attached to said lower end of said lower ladder section or said lower end of said longitudinal bracing means whereby said at least one of said transverse base members can pivot to conform to an uneven support surface.

8. The extension ladder of claim 1, wherein said spars comprise telescoping spars which can be adjustably extended to stabilize said extension ladder and retracted for storage.

9. The extension ladder of claim 1, wherein each of said pair of spars further comprises a foot member mounted to the lower end of its respective spar to provide increased contact area between said spars and a support surface.

10. The extension ladder of claim 9, wherein each of said foot members is pivotably mounted to the lower end of its respective spar whereby said foot members can pivot to conform to an uneven support surface.

11. The extension ladder of claim 1, wherein said longitudinal bracing frame is attached to said upper end of said lower ladder section by means of said plates, one end of each of said plates being mounted to said upper end of said lower ladder section, and the opposite end of each of said plates being mounted to said longitudinal bracing frame, at least one of said lower ladder section and said longitudinal bracing frame being pivotably mounted to said plates.

12. The extension ladder of claim 1, wherein said plates are mounted to said upper portion of each of said lower ladder sections by means of bolts, and wherein said keeper is mounted to said plate by means of said bolts which mount said plates to said upper portion of each of said lower ladder sections.

13. The extension ladder of claim 1, wherein said keepers further comprise holes formed therethrough, wherein said spars further comprise corresponding holes formed so as to align with said holes in said keepers when said upper ends of said spars are inserted within said keepers and abutting said horizontal lips, and further comprising locking pins inserted through said holes in said keepers and through said holes in said spars so as to further secure said spars within said keepers.

* * * * *